US009210958B1

(12) United States Patent
Hodge

(10) Patent No.: US 9,210,958 B1
(45) Date of Patent: Dec. 15, 2015

(54) NECKTIE

(71) Applicant: Allan M. Hodge, San Diego, CA (US)

(72) Inventor: Allan M. Hodge, San Diego, CA (US)

( * ) Notice: Subject to any disclaimer, the term of this patent is extended or adjusted under 35 U.S.C. 154(b) by 0 days.

(21) Appl. No.: 14/712,607

(22) Filed: May 14, 2015

(51) Int. Cl.
*A41D 25/00* (2006.01)

(52) U.S. Cl.
CPC ..... *A41D 25/003* (2013.01); *A41D 25/005* (2013.01); *A41D 25/008* (2013.01)

(58) Field of Classification Search
CPC ... A41D 27/08; A41D 25/003; A41D 25/008; A41D 25/005; A44C 15/005; Y10T 24/1374; Y10T 24/1397; Y10T 24/199
See application file for complete search history.

(56) References Cited

U.S. PATENT DOCUMENTS

| | | | | | |
|---|---|---|---|---|---|
| D47,097 | S | * | 3/1915 | Bennet | D2/607 |
| D47,181 | S | * | 4/1915 | Bennet | D2/607 |
| 1,446,179 | A | * | 2/1923 | Henkes | 63/23 |
| 2,030,756 | A | * | 2/1936 | Mix | 24/66.2 |
| 2,307,181 | A | * | 1/1943 | Young | 383/22 |
| D146,584 | S | * | 4/1947 | Philippe | D11/8 |
| D158,555 | S | * | 5/1950 | Chernow | D11/8 |
| 2,572,889 | A | * | 10/1951 | Strykower | 224/258 |
| 2,629,874 | A | * | 2/1953 | La Maida | 2/184.5 |
| D176,756 | S | * | 1/1956 | Cowell | D2/607 |
| 2,846,688 | A | * | 8/1958 | Meeker | 2/150 |
| 2,896,217 | A | * | 7/1959 | Cedarstaff | 2/150 |
| 2,987,731 | A | * | 6/1961 | Mills et al. | 2/171.01 |
| 3,105,243 | A | * | 10/1963 | Kampfe et al. | 2/244 |
| 3,134,107 | A | * | 5/1964 | Kelly | 2/171.01 |
| 3,261,025 | A | * | 7/1966 | Simek | 2/149 |
| 3,613,117 | A | * | 10/1971 | Gingerich | 2/149 |
| D268,100 | S | * | 3/1983 | Pederson | D11/7 |
| D273,341 | S | * | 4/1984 | Rol | D2/601 |
| D273,452 | S | * | 4/1984 | Ackerman | D6/578 |
| 4,885,805 | A | * | 12/1989 | Mason | 2/244 |
| 5,338,586 | A | * | 8/1994 | Chalfin | 428/28 |
| 5,379,928 | A | * | 1/1995 | Mikkelsen | 224/257 |
| 5,416,925 | A | * | 5/1995 | Davis | 2/144 |
| 5,461,726 | A | * | 10/1995 | Wade | 2/144 |
| D366,553 | S | | 1/1996 | Wade | |
| 5,722,260 | A | * | 3/1998 | Mangano | 63/3.1 |
| 5,806,732 | A | * | 9/1998 | Hensley | 224/258 |
| 5,884,333 | A | * | 3/1999 | Soliman | 2/145 |
| 6,109,490 | A | * | 8/2000 | Caluori | 224/220 |
| D443,724 | S | * | 6/2001 | Neary | D28/41 |
| 6,381,985 | B1 | * | 5/2002 | Burgard | 63/29.1 |
| 6,401,251 | B1 | | 6/2002 | Fredenberg | |
| 6,422,036 | B1 | * | 7/2002 | Giannis et al. | 63/3.1 |
| 6,519,778 | B2 | * | 2/2003 | Arias et al. | 2/207 |
| 6,729,159 | B2 | * | 5/2004 | Rose | 63/29.1 |

(Continued)

FOREIGN PATENT DOCUMENTS

CN 202738882 2/2013

*Primary Examiner* — Richale Quinn
(74) *Attorney, Agent, or Firm* — Procopio, Cory, Hargreaves & Savitch, LLP

(57) ABSTRACT

A multi-strand necktie has a neck portion for securing around a wearer's neck, a fastener or gathering device secured to the neck portion for location at the front of the wearer's neck, and a plurality of elongated strands having first and second ends, and a gathering device which secures first end portions of the strands together at the front of a wearer's neck or upper chest, with the strands hanging freely from the gathering device to form a bunch of strands extending down from the wearer's neck, similar in appearance to a horse tail or pony tail.

13 Claims, 7 Drawing Sheets

(56) References Cited

U.S. PATENT DOCUMENTS

| | | | | |
|---|---|---|---|---|
| D561,938 | S * | 2/2008 | Madden | D28/41 |
| D561,939 | S * | 2/2008 | Madden | D28/41 |
| 7,591,050 | B2 * | 9/2009 | Hammerslag | 24/68 SK |
| 7,654,112 | B2 * | 2/2010 | Pons | 63/41 |
| D652,757 | S * | 1/2012 | Aug et al. | D11/5 |
| D711,277 | S * | 8/2014 | Slimane | D11/8 |
| 2003/0084836 | A1 | 5/2003 | Stephens | |
| 2004/0111005 | A1 * | 6/2004 | Lu | 600/15 |

* cited by examiner

NECKTIE

BACKGROUND

1. Field of the Invention

This invention relates generally to neckties, and is particularly concerned with a bolo-style necktie or the like.

2. Related Art

A bolo tie is a type of necktie consisting of a length of cord, braided leather, or the like which is looped around the neck and secured at the front of the neck with a clasp or slide which may be ornamental, with the two ends of the cord hanging free. Traditional neckties are tied by hand and typically are made from tapered pieces of fabric of various types and designs. Clip-on ties are also available, which avoid the need for the individually to tie the necktie correctly at the front of the neck so that it hangs properly. There have been very few improvements or changes in basic necktie or bolo tie styles over many years.

SUMMARY

In one aspect, a necktie or tie comprises a neck portion for securing around a wearer's neck, a gathering device or fastener secured to the neck portion for location at the front of the wearer's neck, and a plurality of elongated strands having first ends secured to the gathering device or fastener and second free ends, the strands hanging freely from the gathering device or fastener to form a bunch of strands extending down from the wearer's neck. The strands and neck portion may be of the same or different materials, and the neck portion may comprise a strand of fabric or string which has ends extending through the clasp or fastener and dependent from the gathering device or fastener along with all the other strands. An ornamental clasp or sleeve may be secured over the gathering device.

The strands may have the appearance of a horse tail, and may be relatively thin or may be up to 0.25 inches in width or diameter. The strands may be made of various materials in alternative embodiments, such as string, rope, cord, yarn, leather, braided leather, chains of various metals, or ribbons or strips of various materials or fabrics such as silk, lace, woven fabrics, ribbon, and the like. The strands may all be the same color or different colors. The strands may also be strings with beads at their ends or spaced along their length, or lines of side-by-side beads as in a beaded necklace, and the like. In one embodiment, the necktie may include strands of different materials with different decorative items attached, to produce a different decorative appearance.

The gathering device or fastener may be designed to gather first end portions of the strands together and may be a metal ring or c-ring, or a wrap, loop, or sleeve of heat shrink or other material secured around the first end portions of the strands. In some embodiments, a gathering device of any type secures the first ends of the strands together, and an ornamental clasp is secured over the gathering device. The fastener or clasp may be of material, plastic, or the like and may include decoration such as precious stones or gems, metal with one or more attached precious or semi-precious stones or gems, beading, or other decorative items.

In one embodiment, the neck portion may have free ends for tying around the back of the neck. Alternatively, the neck portion may be secured around the neck by a button or snap fastener arrangement, opposing Velcro® patches or strips on ends of the neck portion, adjustable clasps similar to necklace fasteners, or the like.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which:

FIG. 8 is a front elevation view of part of another embodiment of a multi-strand necktie with upper end portions of the strands secured by a heat shrink wrapper or plastic sleeve or the like;

DETAILED DESCRIPTION

Certain embodiments as disclosed herein provide for a neck tie having multiple strands depending freely from one another from a clasp or gathering device at the front of the neck or upper chest.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1A:
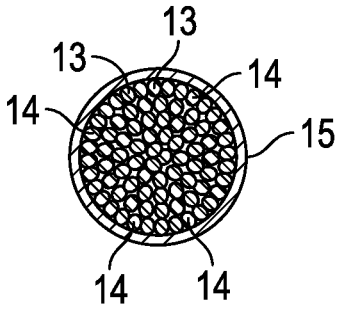
FIG. 1A is a cross-section on the lines 1A-1A of FIG. 1.
Figure 1:
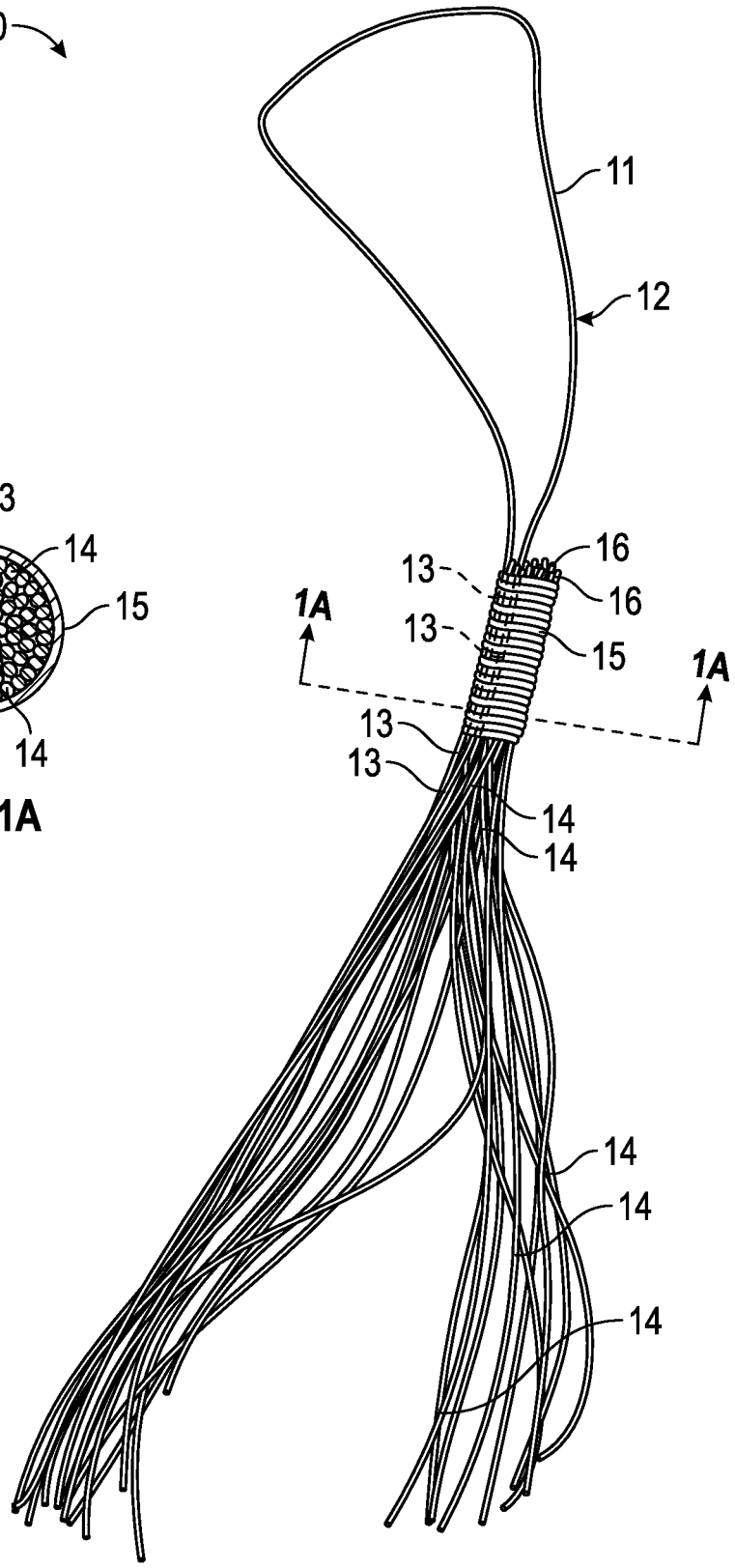
FIG. 1 is a perspective view of one embodiment of a multi-strand necktie.
Figure 2:
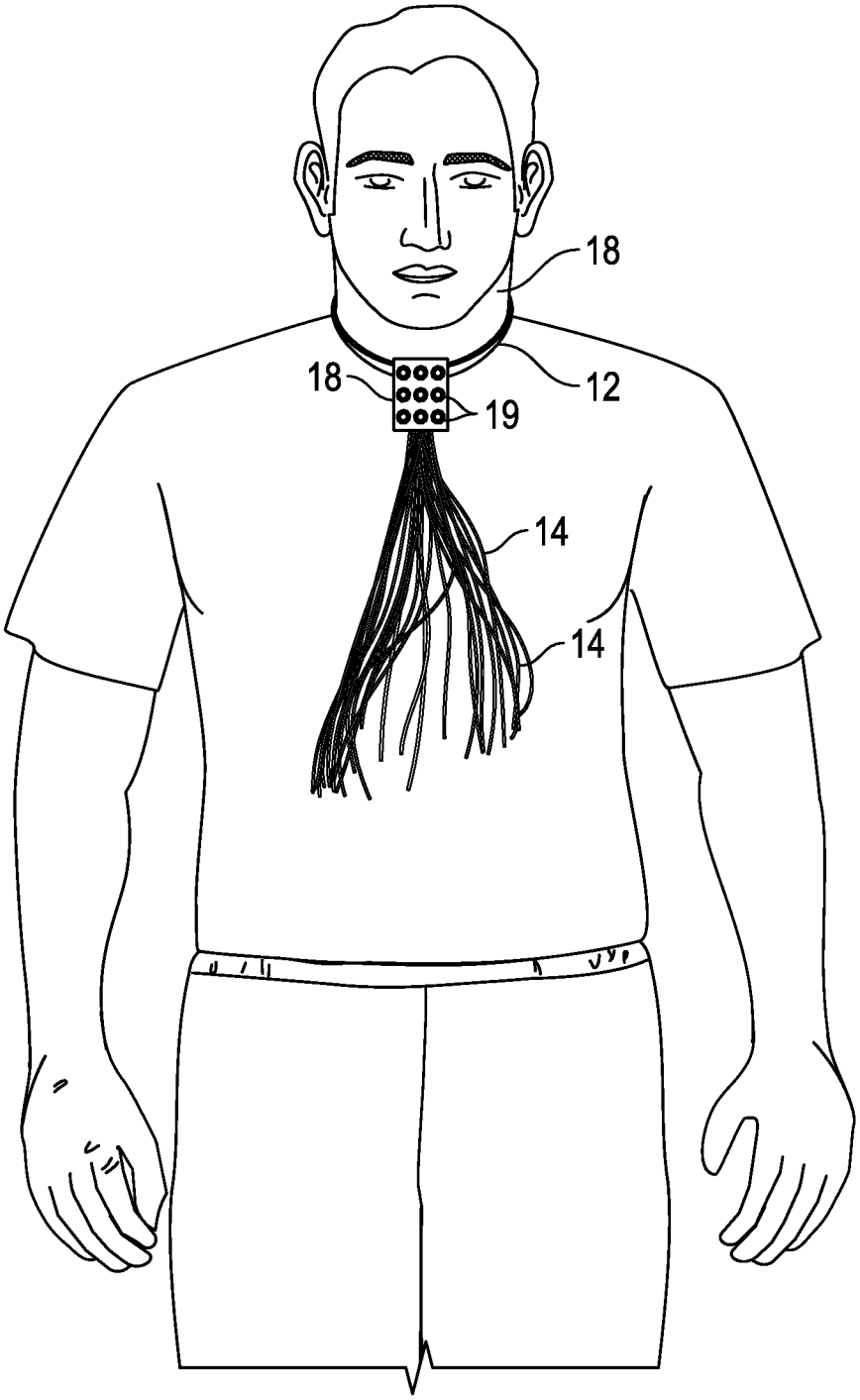
FIG. 2 is a front elevation view illustrating the necktie of FIG. 1 being worn by a user.

FIGS. 1 and 2 illustrate a bolo-like necktie 10 according to one embodiment which has a neck portion or adjustable loop 12 for securing around a wearer's neck, a plurality of elongated strands 14, and a gathering device 15 which gathers first end portions 16 of the strands together and is also secured to the front of neck portion or loop 12 for location at the front of the wearer's neck 18 (see FIG. 1). The strands may be of the same length or substantially the same length, and hang free and separate from one another from gathering or strand holding device 15. The strands and neck portion may be of the same or different materials. In the embodiment of FIGS. 1 and 2, the neck portion is a strand 11 of the same material as the remainder of the strands 14 which hang from device 15, and has end portions 13 extending through the gathering device as illustrated in FIG. 1A and in dotted outline in FIG. 1 and downward from the clasp or fastener device 15 along with all the other strands, as illustrated in FIG. 1. The wearer may pull on loop 12 to make it larger for placing over the wearer's head, then pull protruding end portions 13 of the loop on the lower side of gathering device 15 in order to tighten the loop to the desired fit around the neck. The strands are of around the same length as a conventional gentleman's necktie, and the length of the free end portions of strands 14 extending from gathering device may be around 12 to 15 inches in one embodiment. The strands may all be the same length or of slightly different lengths to produce a different appearance. In other embodiments, the free end portions of the strands may be shorter and terminate closer to gathering device 15.

The strands may have the appearance of a horse tail, and may be relatively thin or may be in the range from one quarter of an inch to one inch in width or diameter. The strands may be made of various materials in alternative embodiments, such as string, rope, cord, twine, hair, yarn, leather, thread, chains of various metals, or strips or ribbons of various fabrics such as silk, lace, wool, polyester, cotton and the like. In the embodiment of FIGS. 1 and 2, the strands 14 are of cord or twine-like material with a generally round cross-section.

The strands may all be the same color or different colors, and some or all of the strands may have patterns, designs or other embellishments thereon. The strands may also be strings with beads at their ends or spaced along their length, or lines of side-by-side beads as in a beaded necklace, and the like. In one embodiment, the necktie may include some strands of different materials with different colors, designs or decorative items attached, to produce a different decorative appearance.

The gathering device 15 may be a seizing of the same strand material as the necktie wrapped multiple times around the end portions 16, as in the embodiment of FIG. 1, or may be a sleeve of other materials such as molded plastic, heat shrink wrap material such as electrical heat shrink, a hog ring or split metal ring secured around the end portions by a plier or the like, a zip tie device such as an electrical cable zip tie plastic fastener, or the like. Alternatively, the end portions of strands 14 may be secured or gathered together by adhesive, stitching, staples, or the like. In any of the above examples, an additional decorative device may be secured over the gathered end portions or gathering device, such as a clasp of metal such as a precious metal, a clasp, clip, or snap on device of molded plastic of various colors and designs, a clasp or snap on device of metal or plastic with gems or other ornamentation on the forward facing surface, a fabric sleeve or wrap, a clip on bowtie, or the like. The decorative clasp or sleeve may include decoration such as precious stones or gems, metal with one or more attached precious or semi-precious stones or gems, beading, or other decorative items. FIG. 2 illustrates a decorative clasp 18 with gems 19 secured over the seizing or gathering device 15 of FIG. 1.

Figure 3:
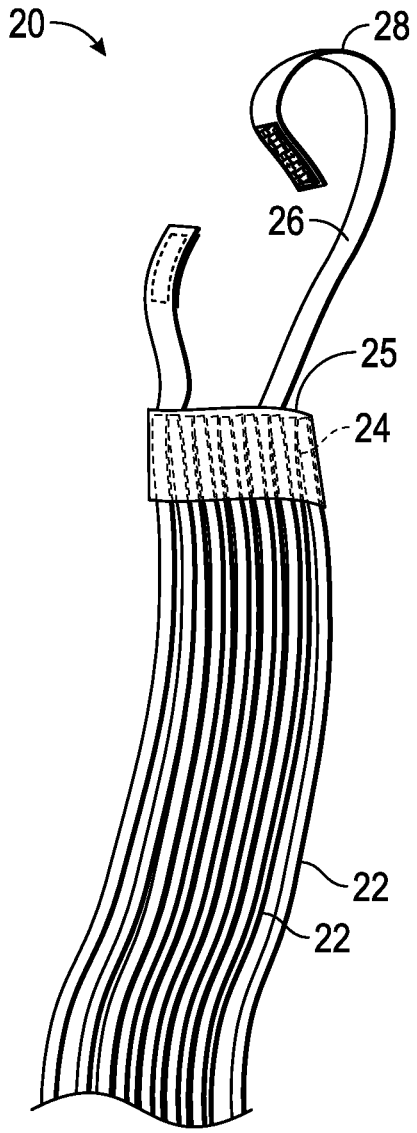
FIG. 3 is a cut away front elevation view of an upper portion of a second embodiment of a multi-strand necktie illustrating a different means of attachment around the wearer's neck.
Figure 4:
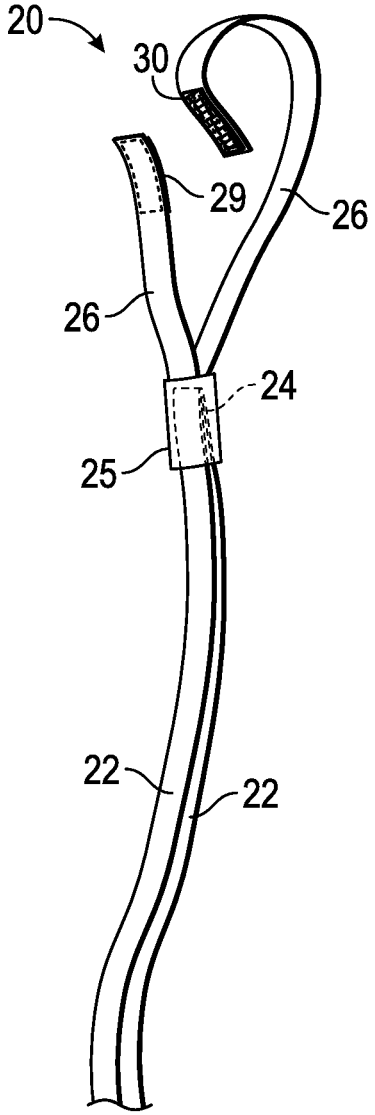
FIG. 4 is a side elevation view of the upper portion of the necktie of FIG. 3.
Figure 5:
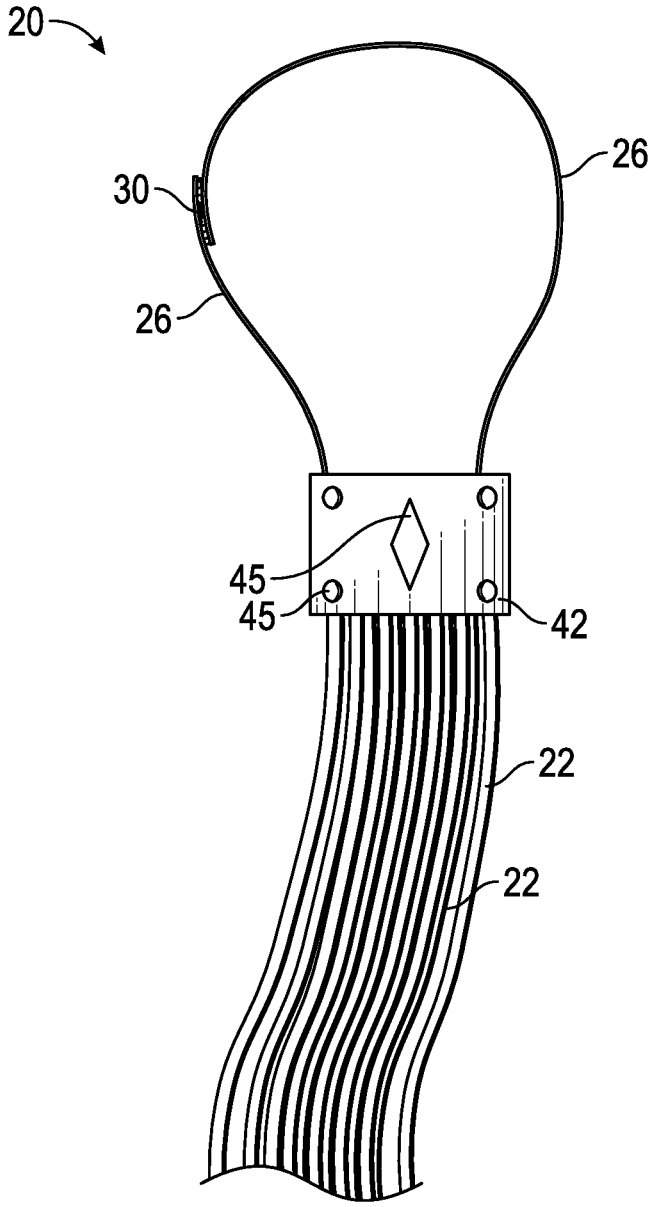
FIG. 5 is a front elevation view of an upper part of the multi-strand necktie of FIGS. 3 and 4 with a decorative clasp or cover engaged over the gathering device.

In another embodiment, the neck portion 12 may be formed in two separate parts extending from the gathering device rather than a continuous loop around the neck, with free ends for tying around the back of the neck. Alternatively, the two parts of the neck portion may have ends secured around the neck by a button or snap fastener arrangement, opposing Velcro® patches or strips on ends of the neck portions, adjustable clasps similar to necklace fasteners, or the like. FIGS. 3 to 5 illustrate another embodiment of a bolo-style necktie 20 in which the strands are strips 22 of fabric or ribbon rather than twine, and may be of one or more colors or of different designs (dotted, striped, etc.). End portions 24 of the ribbons or strips 22 may be stacked on top of one another as seen in FIG. 3 and secured together by a wrapper 25 of adhesive tape or the like, or secured together by stitching or the like. The two outermost ribbons at the top and bottom of the stack have free end portions 26 extending from the upper end of wrapper 25 to form the adjustable neck portion 28. Opposing strips 29, 30 of hook and loop fastener material such as Velcro® are provided adjacent the ends of end portions 26 for securing the neck portion in a loop around a wearer's neck, as seen in FIGS. 3 and 4.

FIG. 5 illustrates the necktie of FIGS. 3 and 4 with the hook and loop fastener strips 30 secured together to form a loop around a wearer's neck, and a decorative clasp or ring device 42 of metal, plastic, or other substantially rigid material or stiff material such as leather or the like secured over gathering device or wrapper 25 in any suitable manner. In one embodiment, ring device 42 is of a precious metal and may have ornaments 45 such as gems or the like secured to the front surface.

Figure 6:
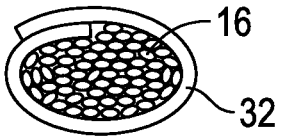
FIG. 6 is a top plan view illustrating an alternative securing or gathering device which secures the upper ends of the strands of a modified necktie together at the front of a wearer's neck.
Figure 7:
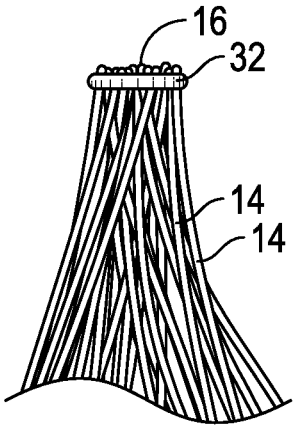
FIG. 7 is a front elevation view of an upper end portion of the necktie illustrating the strands secured by the gathering device of FIG. 6.
Figure 8:
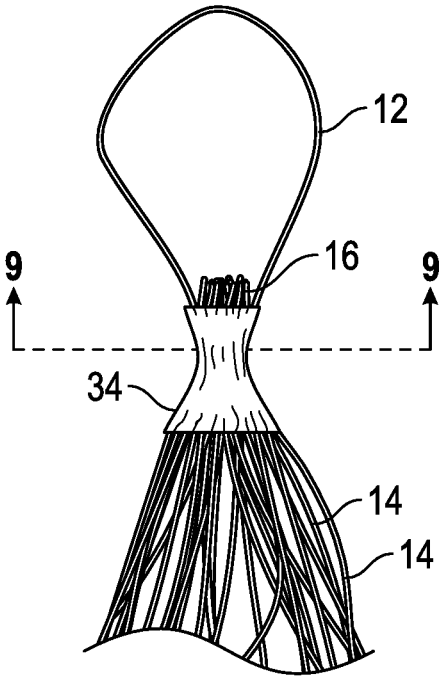
Figure 9:
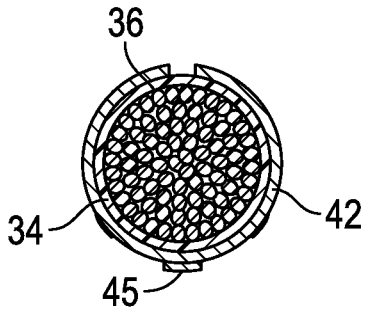
FIG. 9 is a cross-sectional view on the lines 9-9 of FIG. 8 illustrating the upper portion of a multi-strand necktie as in FIG. 8 but with an ornamental clasp similar to that of FIG. 5 secured over the heat shrink wrapper or gathering device.

FIGS. 6 to 8 illustrate some alternative gathering or holding devices for the bundled end portions 16 of strands 14 of FIGS. 1 and 2 (or any other embodiment of the necktie with different types of strands or neck portions). FIGS. 6 and 7 illustrate a bundle of strand end portions 16 secured by a cinched or clamped metal ring or hog ring 32. FIG. 8 illustrates a bundle of strand end portions 16 secured by a sleeve 34 of heat shrink plastic or the like. FIG. 9 is a cross-section on the lines 9-9 of FIG. 8 but with a decorative clasp 42 similar to that of FIG. 5 secured over the sleeve 34 and bundle of strand end portions 16.

Figure 10:
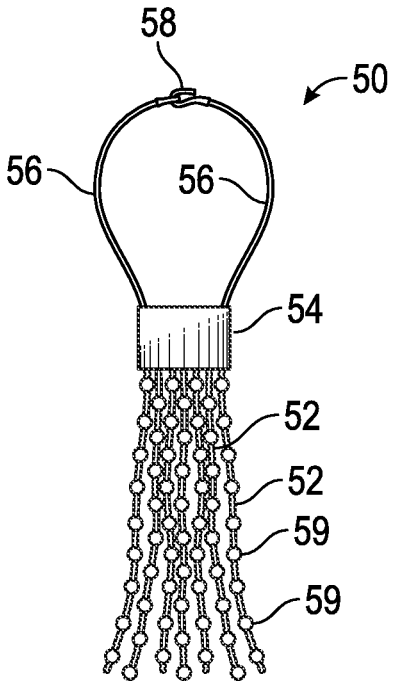
FIG. 10 is a front elevation view of the upper part of another embodiment of a multi-strand necktie where the strands are beaded.

FIG. 10 illustrates another embodiment of a necktie 50 which has multiple strands 52, any suitable gathering device and ornamental clasp 54 securing upper end portions of the strands together, with neck portions 56 of the same or different material from strands 52 extending out of the top of clasp 54 for securing around the neck. In this case, the strands may be metal chains or the like, with a releasable necklace fastener 58 or the like formed at the ends of neck portions 56. Beads 58 may be provided as ornamentation at spaced intervals along the length of each of the freely hanging strands 52. The same design may be used with strands of leather having beads along their length, or strands comprising beads strung along a thread, wire, string or the like.

Figure 11:
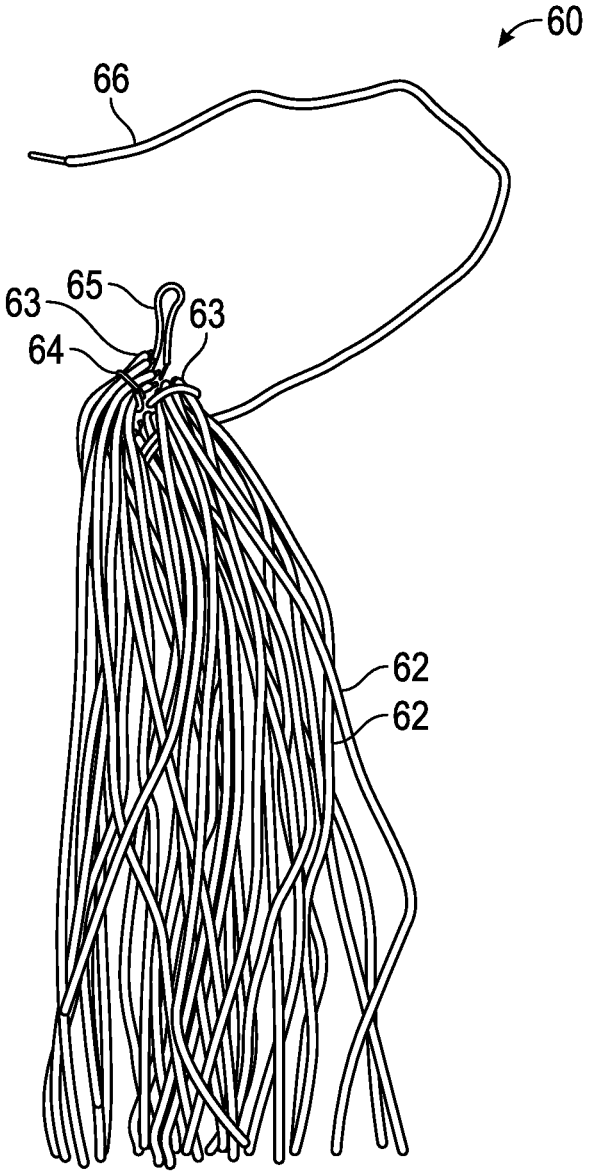
FIG. 11 is a front elevation view of another embodiment of a multi-strand necktie with a different arrangement for securing the neck portion around a wearer's neck.

FIG. 11 illustrates another embodiment of a bolo-style necktie 60 formed from two or more bunches of strands 62 of any of the materials described above. The upper end portions 63 of each bundle of strands are secured together by a suitable gathering device 64, such as a metal c-ring or hog tie cinched around the end portions 63. One strand 66 is longer than the others and forms a neck-engaging portion with a free end, while a loop 65 is formed from another strand. The end of strand 66 is extended through loop 65 and tied in order to secure strand 66 around a wearer's neck. A suitable decorative clasp or the like may be secured around the upper ends of the bundles and gathering devices 64, as in previous embodiments.

The bolo-style necktie described above may be made from many different materials with multiple different ornamentation options to provide different decorative effects when worn by a man or a women. It is relatively inexpensive to manufacture and provides a completely different and unique appearance from a conventional man's necktie or bolo-style tie.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

I claim:

1. A necktie, comprising:

a neck portion forming a loop configured to be secured around a wearer's neck;

a plurality of separate elongated strands having first end portions adjacent the neck portion and opposite second ends;

a gathering device secured to and enclosing the first end portions of the elongated strands, the gathering device comprising a separate outer cylindrical sleeve of flexible material having first and second ends and secured around the first end portions of the plurality of strands whereby the strands extend from the second end of the sleeve;

the neck portion comprising an elongated additional strand of the same material as the plurality of elongated strands and having a length greater than the length of the plurality of strands, the additional strand forming the neck portion loop configured for engagement around a wearer's neck and having integral opposite end portions extending from the loop through the sleeve and hanging free from the sleeve with the plurality of elongated strands, whereby the end portions of the additional strand can be pulled to change the size of the neck loop;

the strands and end portions of the additional strand being of predetermined length sufficient to extend downward from the sleeve to a location closer to the wearer's waist than the wearer's neck when the necktie is worn.

2. The necktie of claim 1, wherein the strands are selected from the group consisting of fabric strips, string, rope, cord, yarn, leather strips, threads, chain, and ribbon.

3. The necktie of claim 1, wherein the sleeve comprises heat shrink wrap material secured around first end portions of the plurality of strands, and a decorative fastener secured over the shrink wrap material.

4. The necktie of claim 1, wherein the first end portions of the plurality of strands are secured together by adhesive and the sleeve encloses the adhered first end portions of the plurality of strands and parts of the opposite end portions of the loop which extend through the sleeve.

5. The necktie of claim 1, wherein at least some of the strands carry beads, each bead-carrying strand having a plurality of beads located at spaced intervals along the length of the strand extending from the gathering device.

6. The necktie of claim 1, wherein the plurality of strands are configured to have the appearance of a horse's tail.

7. The necktie of claim 1, wherein each strand has a cross-sectional dimension of no more than 0.25 inches.

8. The necktie of claim 1, further comprising a metal clasp secured over the sleeve.

9. The necktie of claim 8, wherein the metal clasp is of a precious metal.

10. The necktie of claim 8, further comprising one or more precious stones secured to the metal clasp.

11. A necktie, comprising:

a neck portion forming a loop configured to be secured around a wearer's neck with a first part of the neck portion located at the front of the wearer's neck;

a tubular sleeve having an upper end and a lower end, the neck portion extending out of the upper end of the sleeve;

a bundle of multiple elongated strands having an upper portion secured within the sleeve and opposite lower ends, the bundle of strands hanging free and separate from one another from the lower end of the sleeve to the lower ends of the strands and being of predetermined length configured to extend downward from the sleeve to a location closer to the wearer's waist than the wearer's neck when the necktie is worn; and the neck portion having opposite end portions extending from the loop through the sleeve and hanging free from the sleeve with the plurality of elongated strands to the lower ends of the strands; and wherein the neck portion and elongated strands each comprise a ribbon.

12. The necktie of claim 11, wherein the neck portion forming the loop comprises first and second ribbons extending from the first end of the sleeve and configured to extend around opposite sides of the wearer's neck and securing together at the back of the neck.

13. The necktie of claim 12, further comprising first and second releasable fastener members on the respective first and second ribbons which are releasably engageable to secure the neck portion around a wearer's neck, the fastener members being of mating hook and loop fastener material.

* * * * *